US006688939B1

(12) United States Patent
Novak

(10) Patent No.: US 6,688,939 B1
(45) **Date of Patent: *Feb. 10, 2004**

(54) DECORATIVE BALLOON HOLDER

(75) Inventor: Craig Novak, Kennett Square, PA (US)

(73) Assignee: Unique Industries, Inc.

( * ) Notice: Subject to any disclaimer, the term of this patent is extended or adjusted under 35 U.S.C. 154(b) by 65 days.

This patent is subject to a terminal disclaimer.

(21) Appl. No.: 10/292,932

(22) Filed: Nov. 13, 2002

Related U.S. Application Data

(62) Division of application No. 09/565,709, filed on May 5, 2000, now Pat. No. 6,523,798.

(51) Int. Cl.[7] ..... A63H 3/06
(52) U.S. Cl. ..... 446/220; 248/346.01; 248/176.1
(58) Field of Search ..... 446/220–226; 248/176.1, 504, 910, 506, 346.01, 400.1, 346.03, 346.04, 346.5; D15/199; D19/10

(56) References Cited

U.S. PATENT DOCUMENTS

| | | | | |
|---|---|---|---|---|
| 2,145,921 A | | 2/1939 | Dewitt | |
| 2,783,584 A | * | 3/1957 | Venturella | 446/225 |
| 2,956,287 A | | 10/1960 | Stanford | |
| 3,700,151 A | | 10/1972 | Youngstrom | |
| 3,747,887 A | | 7/1973 | Binkley | |
| 4,038,777 A | * | 8/1977 | Schwartz | 446/225 |
| 4,296,693 A | | 10/1981 | Archer | |
| 4,777,066 A | | 10/1988 | White et al. | |
| 4,795,117 A | | 1/1989 | Siteman | |
| 4,957,299 A | * | 9/1990 | Richardson | 273/409 |
| 5,011,447 A | | 4/1991 | Watanabe | |
| 5,016,848 A | | 5/1991 | Metz | |
| 5,024,011 A | | 6/1991 | Collins | |
| 5,035,391 A | | 7/1991 | Steele et al. | |
| 5,074,510 A | | 12/1991 | Metz | |
| 5,411,427 A | | 5/1995 | Nelson et al. | |
| 5,452,877 A | | 9/1995 | Riffle et al. | |
| 5,520,364 A | | 5/1996 | Bloxson et al. | |
| 5,662,510 A | | 9/1997 | Wolens | |
| 5,755,419 A | | 5/1998 | Gearhart et al. | |
| 5,842,670 A | | 12/1998 | Nigoghosian | |
| 5,842,925 A | | 12/1998 | Ellroy et al. | |
| 6,076,758 A | | 6/2000 | Kieves et al. | |
| D441,279 S | | 5/2001 | Remar | |
| 6,241,389 B1 | | 6/2001 | Gilmore et al. | |

OTHER PUBLICATIONS (Birthday Balloons–G005) Gifts for all occassions (http:/ www.iflora.co.za/gifts.asp) 2000.
The Red Balloon Company—Balloon Centerpiece Weights (http:/www.red balloon.com/decorating/ cp_weights.htm, 1999.
The F.U.N. Place: Craft board Archieves, Giftbags and Wraps; posted by Zzida on Mar. 25, 1999 at 10:55:59.

* cited by examiner

*Primary Examiner*—Derris H. Banks
*Assistant Examiner*—Bena B. Miller
(74) *Attorney, Agent, or Firm*—Gerard F. Dunne, Esq.

(57) ABSTRACT

A decorative balloon holder has a core having sufficient weight to hold a buoyant balloon in position on a tabletop or the like. The balloon holder has an attachment held directly to the core for securing the string of the balloon, and has a layer of decorative material wrapped around the core.

20 Claims, 4 Drawing Sheets

DECORATIVE BALLOON HOLDER

PRIOR APPLICATION

This application is a division of application Ser. No. 09/565,709 filed May 5, 2000 and now U.S. Pat. No. 6,523,798 granted on Feb. 25, 2003.

FIELD OF THE INVENTION

The present invention relates to a decorative holder for securing a buoyant balloon in position on a tabletop or the like.

BACKGROUND OF THE INVENTION

Various devices for holding a buoyant party balloon in a desired position on a tabletop have been proposed, but such products are often not very attractive for use at a festive occasion such as a birthday party, or are relatively expensive to manufacture. The products disclosed in U.S. Pat. Nos. 5,011,447; 5,016,848; 5024011; 5,035,391; 5,074,510; 5,662,510 or 5,755,419, for example, are manufactured by molding synthetic plastics or comparable techniques and the resulting products can not usually be made festive in appearance without additional expense or bother for the consumer.

Balloon holders formed of weighted mass of compacted sand, or cement and sand mixtures, have been proposed that are wrapped in a festive paper, and such balloon holders have met a need for inexpensive but festively decorated party props to secure buoyant balloons. In such products, however, the string to secure the balloon is often tied around the decorative paper or otherwise held to the holder in a manner that does not hold the balloon in a secure and long-lasting manner.

It is, therefore, an object of the present invention to provide a festive balloon holder that can be manufactured inexpensively and yet can hold a balloon securely in place.

SUMMARY OF THE INVENTION

According to the present invention, a holder to secure a buoyant balloon having a string for securing the balloon has a core with sufficient weight to hold the balloon in place. An attachment for securing the string of the balloon is held directly to the core and a decorative layer of material is held around the core. In this way, the attachment is held to the strongest part of the balloon holder and yet does not interfere with the decorative layer to provide a festive holder.

In preferred form, the attachment is formed of a transparent material and may be simply taped to the core; and the decorative layer is wrapped around the core and held by a simple twist tie.

These and other objects, and advantages and features of the present invention will become apparent from the description given below which is made in conjunction with the following drawing figures.

Figure 1:
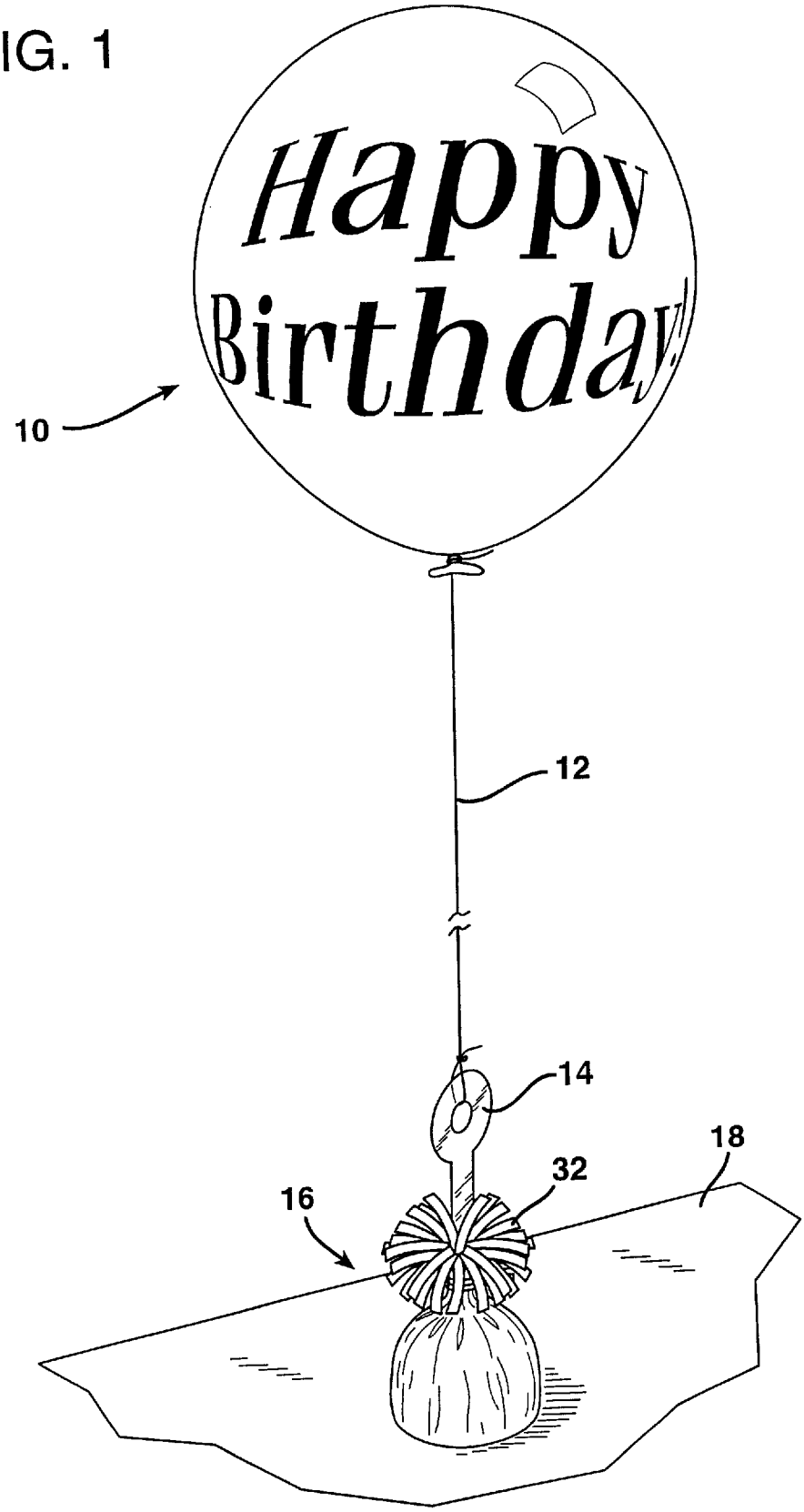
FIG. 1 is a perspective view of a balloon holder according to the present invention.

As illustrated in FIG. 1, a party balloon 10 has a string 12 tied to an opening in an attachment 14 of a decorative balloon holder 16 of the present invention. The balloon holder 16 is resting on a tabletop 18 and has sufficient weight to counteract the buoyancy of the balloon 10.

Figure 2:
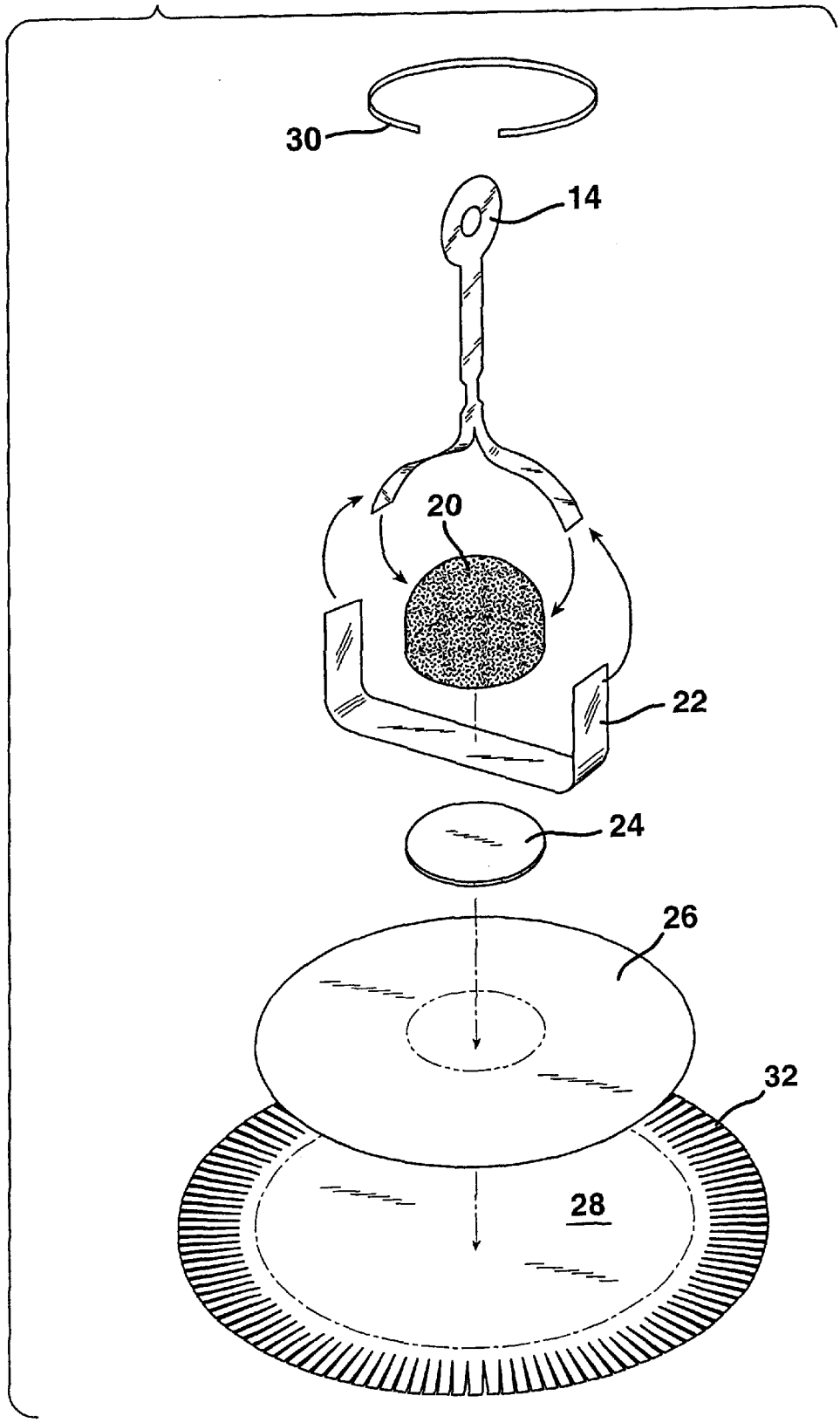
FIG. 2 is an exploded view thereof.
Figure 3:
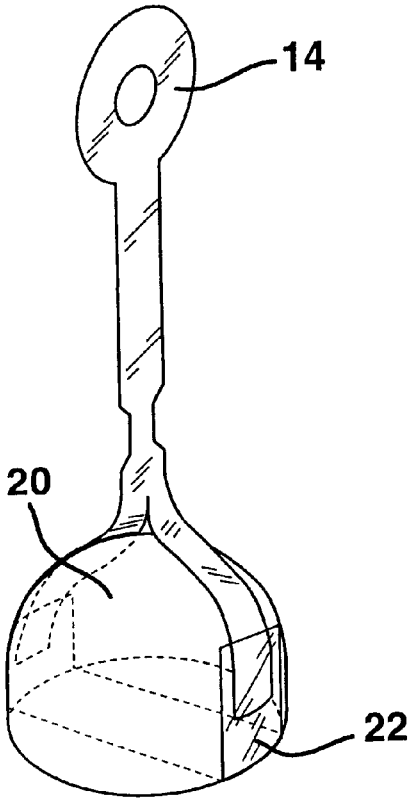
FIGS. 3 through 6 illustrate the assembly of a balloon holder of the present invention.
Figure 4:
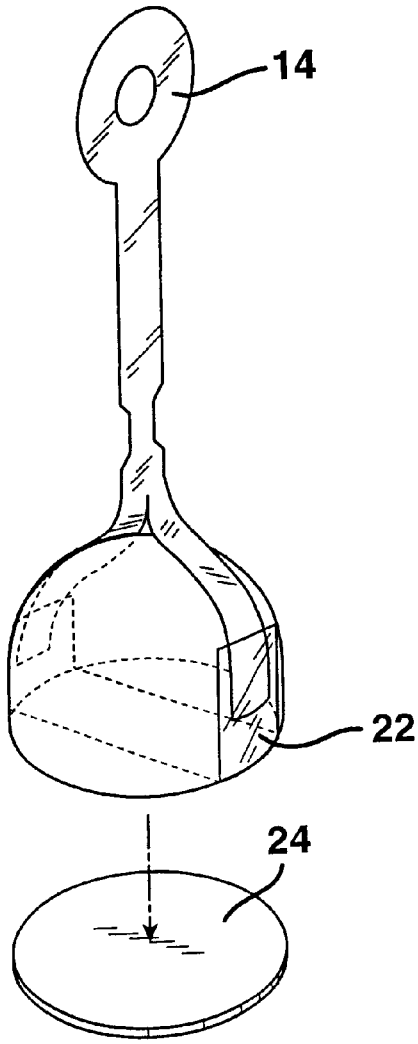

FIG. 2 illustrates the construction of the balloon holder 16, and a core 20 formed of an inexpensive but weighty material such as compressed sand held by an adhesive or a sand, cement and water mixture. A mixture of approximately 72% sand, 24% cement and 4% water has been found satisfactory to hold a typical Mylar balloon inflated with helium. The core 20 has the attachment 14 secured thereto in an inexpensive manner, and preferably is held by a strip of adhesive tape 22. In this way, the attachment 14 for securing the string 12 of the balloon 10 is held directly to the substantial core 20.

A layer 24 of paperboard or cardboard is provided beneath the core 20 and serves to prevent abrasion of the core, and a protective layer 26 of thin plastics material is also provided.

Figure 6:
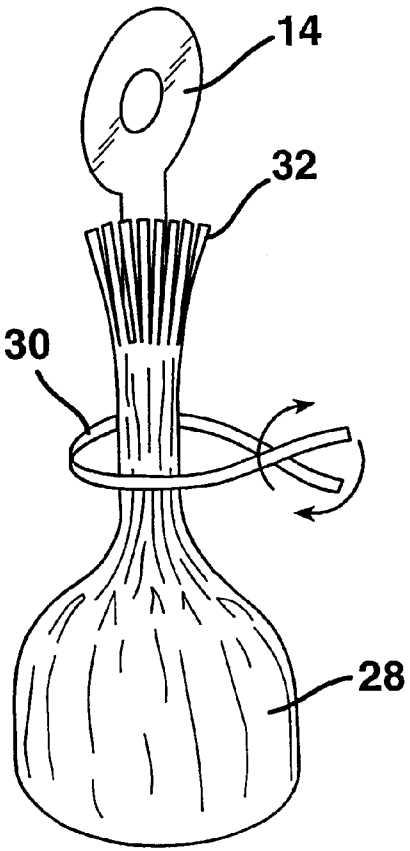
Figure 5:
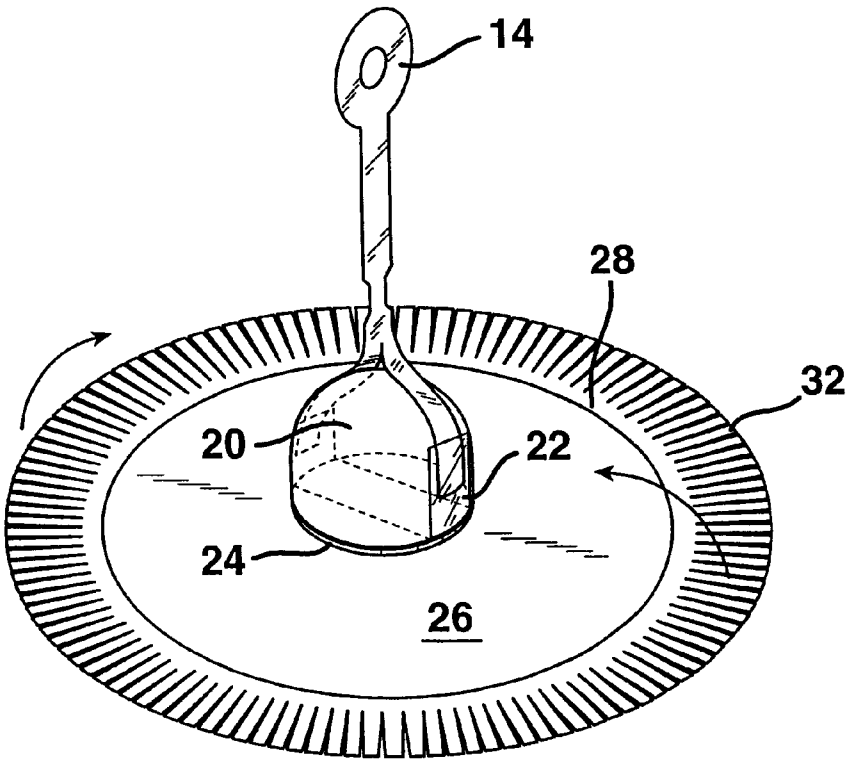

An outer decorative layer 28 of festive paper is then wrapped over the assembly as illustrated in FIGS. 5 and 6, and a twist tie 30 is provided to secure the decorative layer in place. By wrapping the outer decorative layer around the core and securing with the twist tie 30, the attachment 14 is held even more securely to the core 20 and, in this way, the use of an inexpensive tape 22 is sufficient to hold the attachment within the holder.

Preferably, the attachment 14 is made from a transparent material and the twist tie is of a color to match the festive outer layer 28. As shown, the upper portions of the outer layer 28 may be slit to provide streamers 32 further enhancing the festive nature of the balloon holder.

These and other objects, advantages and features of the present invention will be understood from the detailed description made above; and it is understood that the present invention is not limited by any other details set forth above, but by the appended claim.

What is claimed is:

1. A holder for securing a buoyant balloon having a string for securing the balloon, including a core having sufficient weight to hold a buoyant balloon in place, an attachment adapted to secure the string of a balloon and held to said core, and a decorative layer of material held around said core to cover the portion of said attachment held to said core and serving to help hold said attachment to said core.

2. A holder for a balloon as set forth in claim 1, said decorative layer of material being held closely around said core.

3. A holder for a balloon as set forth in claim 2, said decorative layer being wrapped around said core.

4. A holder for a balloon as set forth in claim 3, said decorative layer being held in place by a twist tie.

5. A holder for a balloon as set forth in claim 4, said attachment extending beyond said twist tie.

6. A holder for securing a buoyant balloon having a string for securing the balloon, including a core having sufficient weight to hold a buoyant balloon in place, an attachment adapted to secure the string of a balloon and held to said core, and a decorative layer of material wrapped closely around said core to cover the portion of said attachment held to said core.

7. A holder for a balloon as set forth in claim 6, including a twist tie to hold said decorative layer around said core.

8. A holder for a balloon as set forth in claim 7, said attachment extending beyond said twist tie.

9. A holder for securing a buoyant balloon having a string for securing the balloon, including a core having sufficient weight to hold a buoyant balloon in place, an attachment adapted to secure the string of a balloon and held to said core, and a decorative layer of material wrapped around said core to cover the portion of said attachment held to said core, said attachment extending outwardly from said decorative layer to enable a string of a buoyant balloon to be secured thereto.

10. A holder for a balloon as set forth in claim 9, said decorative layer of material being wrapped closely around said core.

11. A holder for a balloon as set forth in claim 10, said decorative layer being held in place by a twist tie.

12. A holder for a balloon as set forth in claim 11, said attachment extending beyond said twist tie.

13. A holder for securing a buoyant balloon having a string for securing the balloon, including a core designed and constructed to have sufficient weight to hold at least one buoyant balloon in place, an attachment for securing the string of said balloon, said attachment having a portion held to said core and an upper portion extending upwardly for receiving the string of said balloon, and a decorative layer of material held around said core and concealing the portion of the attachment held to said core.

14. A holder for a balloon as set forth in claim 13, said decorative layer being wrapped around said core from the lower portion thereof, said upper portion of said attachment extending upwardly from said decorative layer.

15. A holder for a balloon as set forth in claim 14, said core tapering towards its upper end and said decorative layer being gathered about said upper end to be held in place.

16. A holder for a balloon as set forth in claim 15, said decorative layer being held in place by a twist tie.

17. A holder for a balloon as set forth in claim 16, said attachment extending beyond said twist tie.

18. A holder for securing a buoyant balloon having a string for securing the balloon, including a core designed and constructed to have sufficient weight to hold at least one buoyant balloon in place, an attachment for securing the string of said balloon, said attachment having a portion held to said core and an upper portion extending upwardly for receiving the string of said balloon, and a decorative layer of material held around said core and concealing the portion of the attachment held to said core, said upper portion of said attachment extending upwardly from said decorative layer.

19. A holder for a balloon as set forth in claim 18, said core tapering towards its upper end and said decorative layer being gathered about said upper end to be held in place.

20. A holder for a balloon as set forth in claim 19, said decorative layer being held in place by a twist tie.

* * * * *